US006358101B1

(12) United States Patent
Noro et al.

(10) Patent No.: US 6,358,101 B1
(45) Date of Patent: Mar. 19, 2002

(54) CONNECTOR HAVING A TERMINAL RETAINER

(75) Inventors: Yutaka Noro; Masamitsu Chishima; Matthew Grant, all of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/560,327

(22) Filed: Apr. 28, 2000

(30) Foreign Application Priority Data

Apr. 28, 1999 (JP) ..... 11-122589

(51) Int. Cl.[7] ..... H01R 13/514
(52) U.S. Cl. ..... 439/752; 439/163; 439/145
(58) Field of Search ..... 439/752, 136, 439/145, 686, 902, 188

(56) References Cited

U.S. PATENT DOCUMENTS

| | | | | |
|---|---|---|---|---|
| 3,209,061 A | | 9/1965 | Mier et al. | |
| 3,557,298 A | | 1/1971 | Thompson et al. | |
| 4,211,463 A | * | 7/1980 | Chandler | 439/902 X |
| 4,944,685 A | | 7/1990 | Schulte | |
| 5,080,598 A | | 1/1992 | Shotey | |
| 5,085,599 A | | 2/1992 | Maejima et al. | |
| 5,326,287 A | * | 7/1994 | Hamakita et al. | 439/752 |
| 5,356,302 A | | 10/1994 | Inoue et al. | |
| 5,489,224 A | * | 2/1996 | Schwarz | 439/752 |
| 5,573,432 A | | 11/1996 | Hatagishi | |
| 5,803,756 A | * | 9/1998 | Furutani et al. | 439/188 |
| 5,842,892 A | | 12/1998 | Heimueller et al. | |
| 5,879,201 A | | 3/1999 | Fukamachi et al. | |

FOREIGN PATENT DOCUMENTS

| | | |
|---|---|---|
| EP | 1009065 | 6/2000 |
| GB | 2245775 | 1/1992 |
| JP | 61-90174 | 6/1986 |

* cited by examiner

*Primary Examiner*—Brian Sircus
*Assistant Examiner*—Son V. Nguyen
(74) *Attorney, Agent, or Firm*—Greenblum & Bernstein, P.L.C.

(57) ABSTRACT

The present invention relates to a connector wherein a retainer slides from a side direction of a connector housing in which it is to be installed. An object of the present invention is to provide a connector capable of preventing a connector connected in a condition in which the retainer is not installed, and transferred to subsequent processes. As a solution, a housing main body is provided with a slider capable of sliding, the slider is hooked in a regulating position in a condition in which the retainer is not installed on the housing main body, and interferes with detection pins provided on a male connector. Therefore the connection of both the connectors becomes impossible. To the contrary, when the retainer is installed on the housing main body, the slider is transferred from a regulating position to a permitting position by the slider contact part provided on the retainer which does not interfere with the detection pins, and the connection of both connectors is permitted. Thus, connection of the connectors in a condition in which the retainer is not installed, and transfer to subsequent processes can be prevented.

12 Claims, 15 Drawing Sheets

CONNECTOR HAVING A TERMINAL RETAINER

FIELD OF THE INVENTION

The present invention relates to a connector including locking pieces that lock at least one terminal fitting of a wire within cavities in the connector housing, and a retainer to engage the locking pieces to provide a double lock.

BACKGROUND OF THE INVENTION

As an example of this type of conventional connector, a connector described in Japanese Patent Publication (Unexamined) Show No. 61-90174 is shown in FIG. 15 and FIG. 16. A connector housing 1 installed in the connector is equipped with lances 4 locking terminal fittings 3 in cavities 2. Bending cavities 4A of the lances 4 open to a retainer insertion part 5 formed on a side face of the connector housing 1. Further, a retainer 6 includes a plurality of regulating pieces 6B which extend in a horizontal direction from a vertical plate 6A. When the retainer 6 is installed by sliding from the side direction of the connector housing 1, the regulating pieces 6B advance into the bending cavities 4A to regulate the bending deformations of the respective lances 4, and therefore the terminal fittings 3 are double hooked within the cavities 2.

The above-mentioned conventional connector can be fitted with an opposite connector even though the retainer 6 is not installed. Accordingly, there has been a problem that the connector connected in a condition in which the retainer 6 is not installed is transferred to subsequent processes.

The present invention has been provided to overcome the problems of the prior art noted above, and an object is to provide a connector that prevents connection of the connector in a condition in which the retainer is not installed, and then transferred to subsequent processes.

SUMMARY OF THE INVENTION

The connector according to one aspect of the present invention is a connector that double hooks terminal fittings in a connector housing by sliding a retainer from the side for installation into the connector housing which stores the terminal fittings. The connector has a construction in which pins that protrude from an opposite connector in a fitting direction advance in a receiving part opened in front of the connector housing when the connector housing is fitted in the opposite connector.

The connector housing is provided with a slider which hooks at a regulating position to regulate the advance of the pins into the receiving part, and which slides from the regulating position in a direction transversing the receiving part and moves to a permission position permitting the advance of the pins into the receiving part. A retainer is provided that includes a slider contact part which is in contact with the slider in a process of being installed into the connector housing and moves the slider to the permission position.

In another aspect of the present invention, the inside of the receiving part is provided with a pair of fitting-detection terminals in a contact condition, and the pins of the opposite connector are formed by an insulation member and are configured to fit between the contact faces of both fitting-detection terminals when the connector housing and the opposite connector come to be in a regular fitting condition.

In a further aspect of the present invention, a rear end wall which engages and leaves from a side wall of the connector housing is provided on the rear end of the retainer in the sliding direction. Side wall holes communicating with a slider storing part are formed on the part of the connector housing confronting the rear end wall and a slider contact part protrudes from the rear end wall and is configured to advance into the side wall holes of the connector housing.

In the connector according to another aspect of the present invention, in a condition in which the retainer is not installed, the slider installed on the connector housing hooks at the regulating position, interferes with the pins provided in the opposite connector, and the connection of both connectors is impossible. Whereas when the retainer is installed, the slider is pushed by the slider contact part provided on the retainer and moves from the regulating position to the permission position, where the slider does not interfere with the pins, and the connection of both connectors is permitted. Thus, connection of both connectors in a condition in which the retainer is not installed, and transferred to subsequent processes, is prevented.

Furthermore, when both connectors are in a regular fitting condition, the pins provided in the opposite connector enter between the contact faces of both fitting-detection terminals, such that both fitting-detection terminals are switched from a contact condition to a non-contact condition. Therefore it can be detected that both connectors were properly fitted together.

Additionally, in another aspect of the present invention, when the retainer is installed on the connector housing, the slider contact part that protrudes from the rear end wall of the retainer advances into the slider storing part and moves the slider to the permission position.

In a further aspect of the present invention, a connector assembly is provided that includes a first connector connectable to a second connector. The first connector includes at least one outwardly protruding pin, and the second connector includes a housing main body that houses at least one terminal fitting. A retainer is slidably mountable on the housing main body to retain the at least one terminal fitting to a stored position, and a pin insertion prevention member if provided that prevents insertion of the at least one protruding pin of the first connector in the event that the retainer is not mounted on the housing main body prior to connection of the first and second connectors. Furthermore, the pin insertion prevention member may include a slider slidably mounted in a recess in a front face of the housing main body.

According to a further aspect of the present invention, the slider may include at least one opening, and in an insertion preventing position of the slider, the at least one opening is offset from an insertion path of the at least one pin, and in an insertion permitting position of the pin, the at least one opening is aligned with the insertion path of the at least one pin.

Moreover, the retainer may include a protrusion formed thereon, with the protrusion being engageable with the slider upon mounting of the retainer on the housing on the housing main body. Thus, when the retainer is mounted on the housing main body to retain the at least one terminal fitting in the stored position, the protrusion engages and automatically shifts the slider from the insertion preventing position to the insertion permitting position.

Furthermore, in another aspect of the present invention, the housing main body may include at least two adjacent cavities that receive a respective one of a pair of terminal fittings, and at least one receiving part is positioned adjacent the at least two cavities. A short circuit terminal is insertable within the receiving part and connectable with the pair of terminal fittings, and the pin of the first connector is receivable within the receiving part and engageable with the short circuit terminal to disconnect the short circuit terminal from the pair of terminal fittings.

Additionally, the pair of terminal fittings may be configured to provide a signal indicating an uninstalled condition of the retainer when the pair of terminals is contacted by the short circuit terminal, and to provide a signal indicating an installed condition of the pair of terminals when not contacted by the short circuit terminal.

According to other aspects of the present invention, the second connector may further include an outer housing that slidably receives the housing main body and the retainer. Additionally, the outer housing may be provided with a pivotable lever, the lever including at least one cam groove, and the first connector may be provided with at least one cam pin receivable within the at least one cam groove, whereby rotation of the pivotable lever, when the cam pin is received within the cam groove, causes movement of the first connector toward engagement with the second connector. Furthermore, the slider may be provided with an elastically deflectable hooking piece, and the recess in the housing main body may include first and second hooking grooves. Accordingly, the hooking piece may be engageable with the first hooking groove to temporarily retain the slider in the insertion preventing position, and the hooking piece may be engageable with the second hooking groove to retain the slider in the insertion permitting position.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

The first embodiment of the present invention is illustrated according to FIG. 1 through FIG. 14 below.

Figure 1:
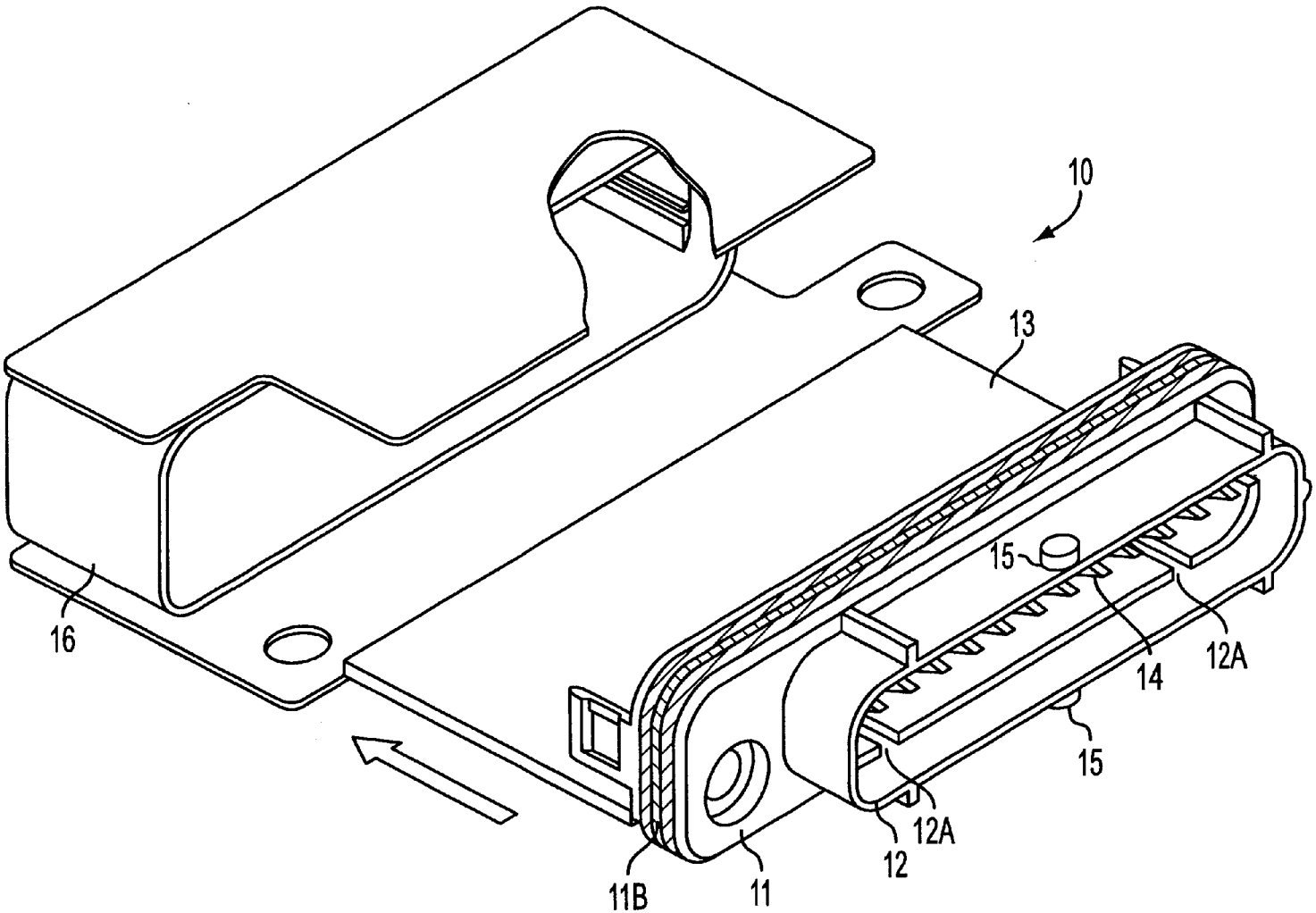
FIG. 1 is a perspective view of the male connector related to one embodiment of the present invention.

A male connector 10 is integrally mounted on a base plate 13 is shown in FIG. 1, and a lever type female connector 20 (FIG. 3), to which the present invention is applied, is connected with the male connector 10.

First, the male connector 10 includes a hood part 12 that protrudes from a principal part 11 which is formed to have a long flat panel shape in a horizontal direction. The principle part 11 is penetrated by first ends of a plurality of L-shaped tabs T (FIG. 2 and FIG. 12(A)) which extend within the inner wall of the hood part 12. Further, the other ends of the tabs T are inserted in a plurality of holes 13A (FIG. 2) formed through the base plate 13, and are soldered on a pattern printed on the base plate 13 to be integrated with the base plate 13.

Figure 12:
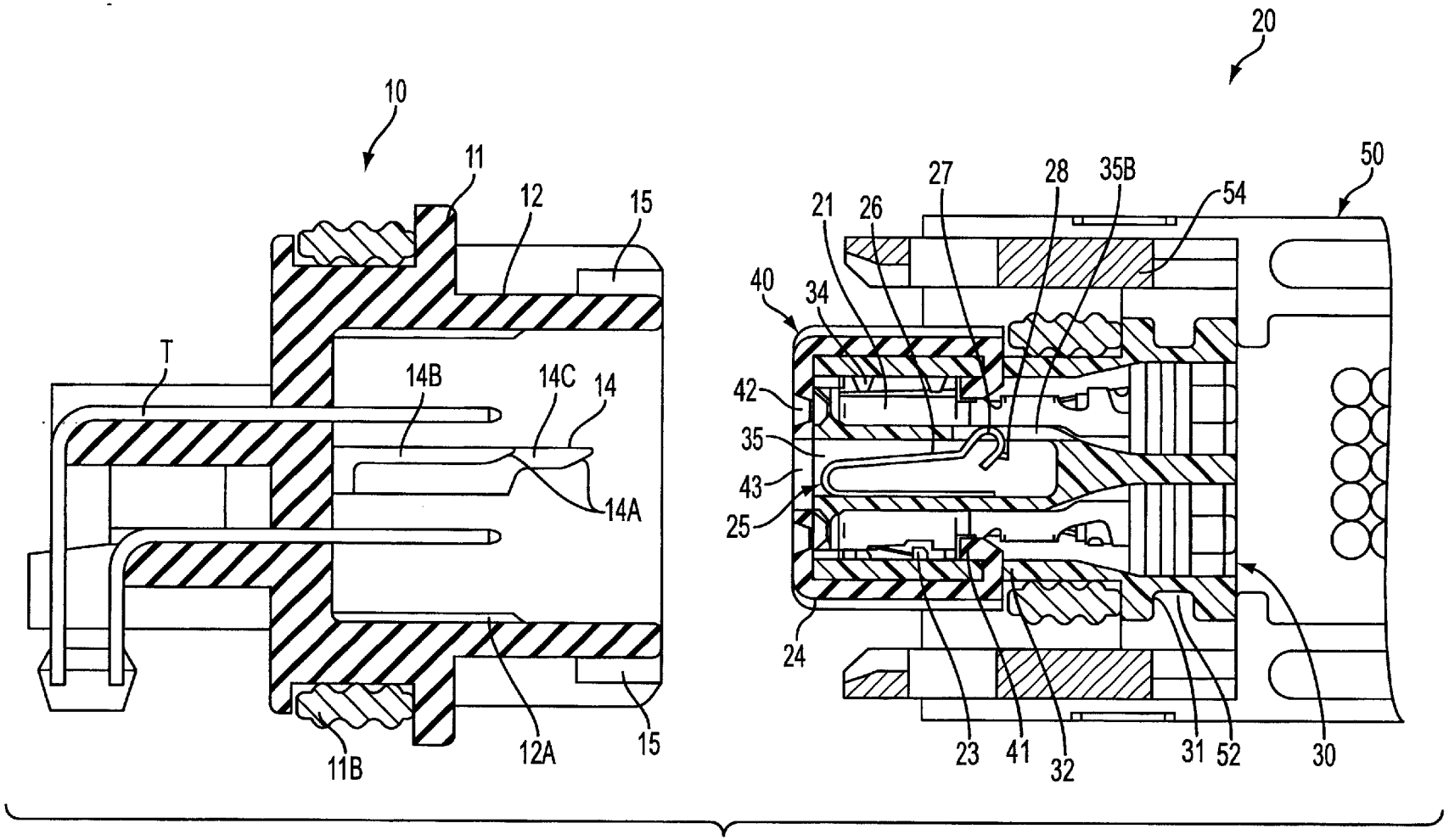
FIG. 12 is a cross-sectional side view showing a condition of disengagement of both the connectors.

A plurality of the tabs T are arranged within the hood part 12 in a pair of upper and lower rows, and a plurality of detection pins 14 made of an insulating resin are arranged in a single row between the two rows of tabs T. The detection pins 14 are shown enlarged in FIG. 13(B), and have a construction that protrusion parts 14C protrude from the center of the upper edge of principal parts 14B which have a T-shape in cross-section. Further, tapered faces 14A which obliquely face downward are formed on the edges of the principal part 14B and the edges of the protrusion parts 14C, as shown in FIG. 12.

Figure 2A:
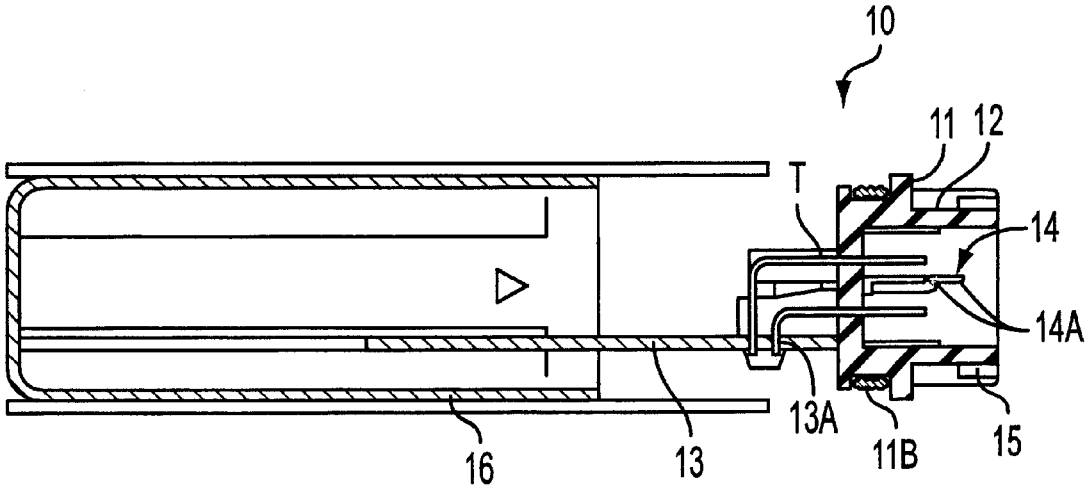
FIG. 2(A) is a cross-sectional side view of the male connector, with the male connector removed from a storage case.
Figure 2B:
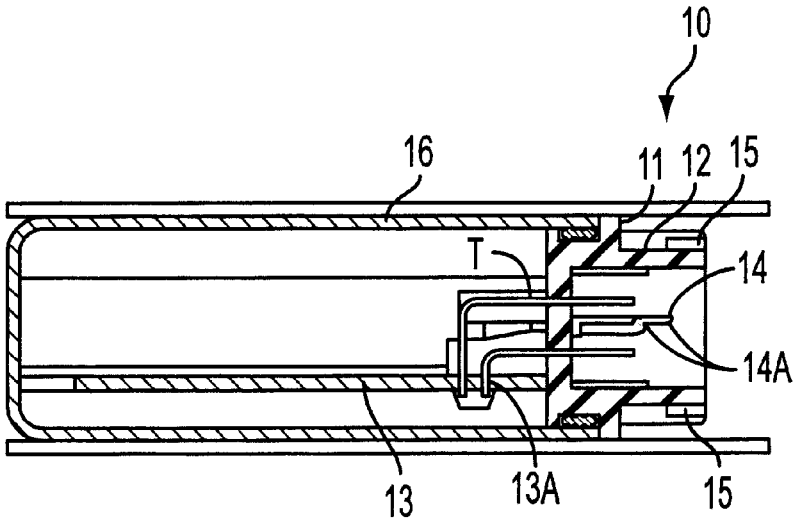
FIG. 2(B) is a cross-sectional side view of the male connector.
Figure 3:
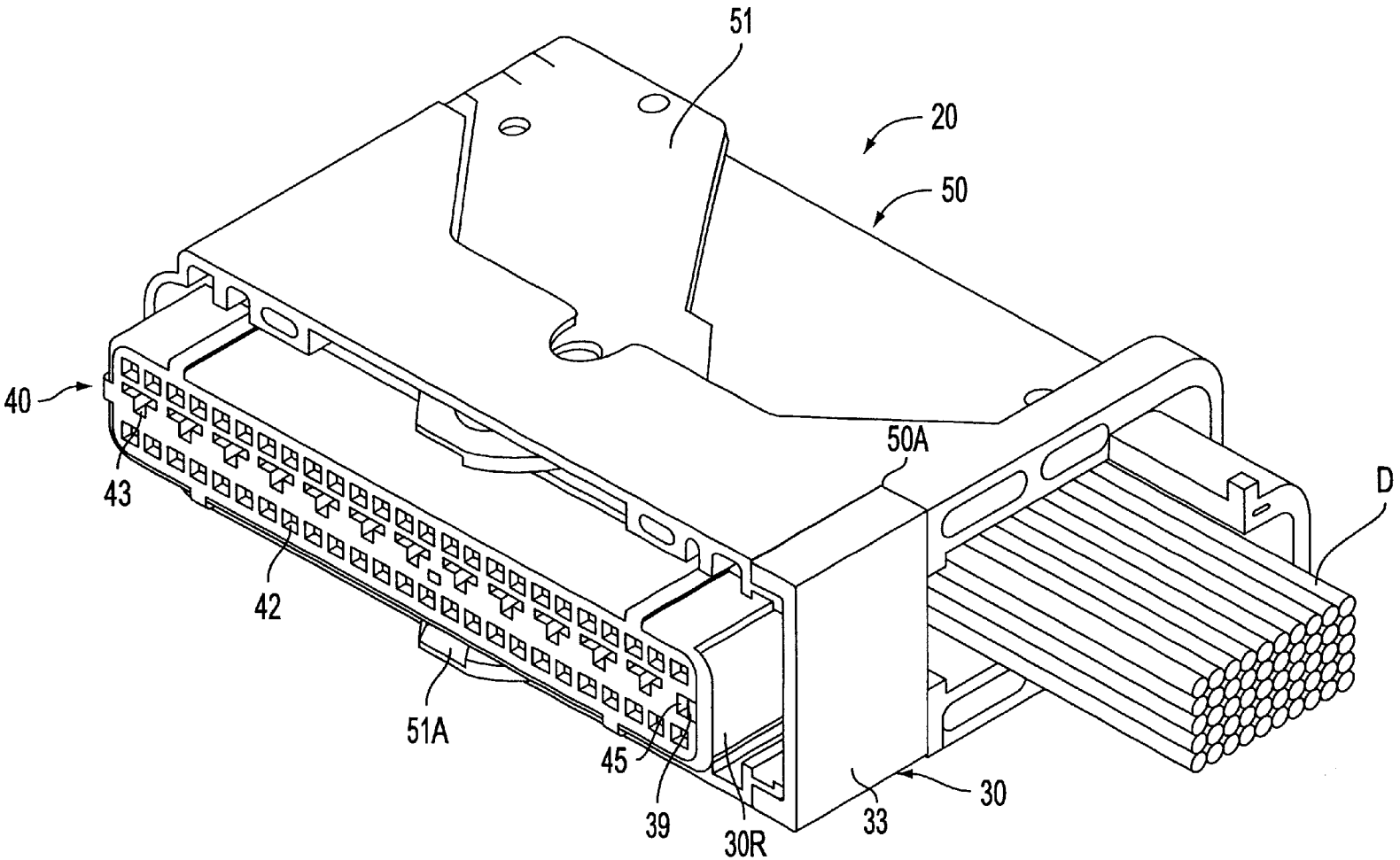
FIG. 3 is a perspective view of the female connector combined with the male connector.

As shown in FIG. 1, a pair of cam pins 15,15 protrude in the upper and lower directions on the outer face of the hood part 12 of the male connector 10. Further, positioning grooves 12A extend in a fitting direction in the inner face of the hood part 12. As shown in FIG. 2(B), the male connector 10 is pushed into a storing case 16 from the side of the base plate 13, and the opening of the storing case 16 is closed in a waterproof condition.

Figure 4:
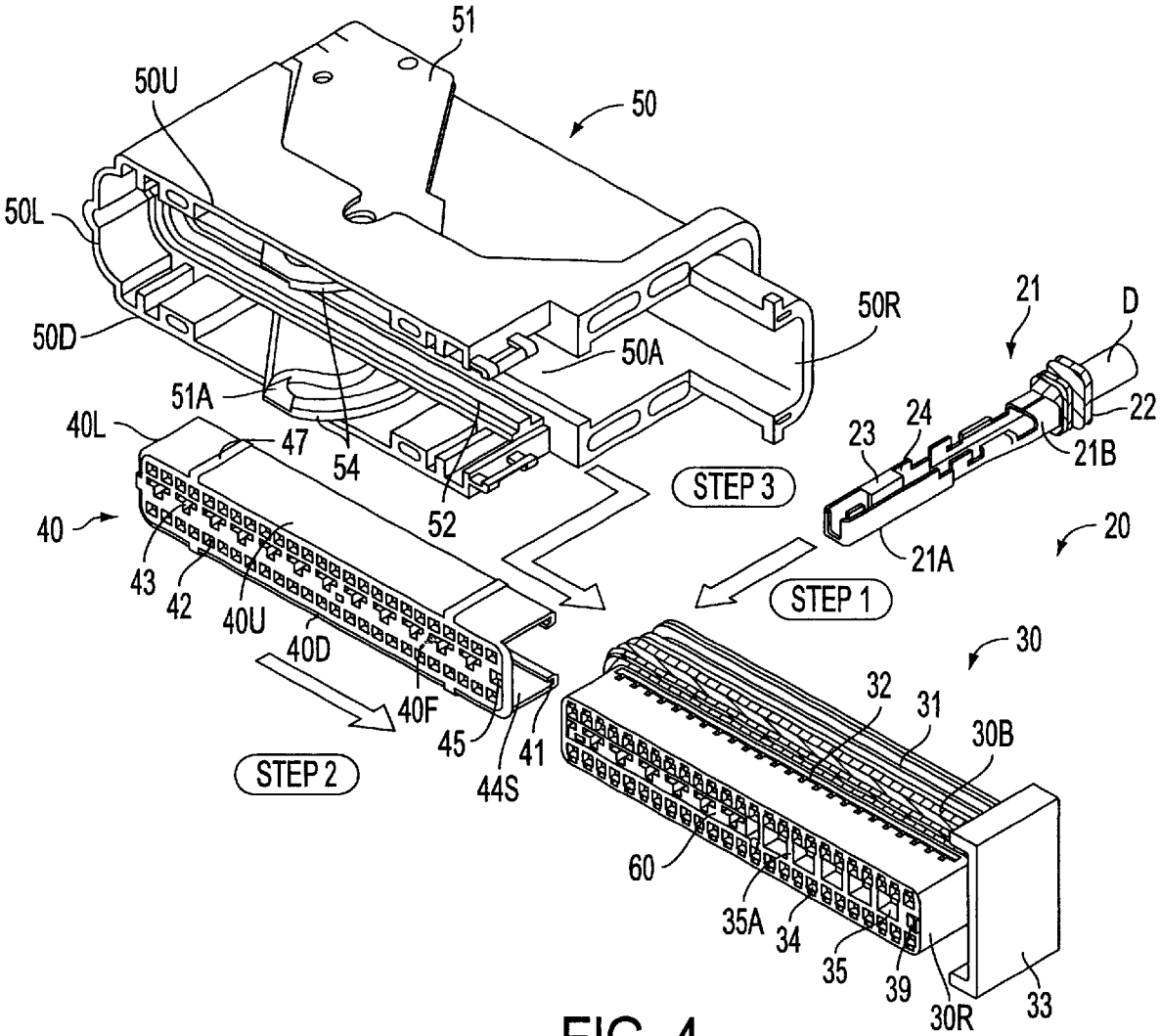
FIG. 4 is an exploded perspective view of the female connector.

On the other hand, as shown in FIG. 4, a female connector 20 to which the present invention is applied is formed of a housing main body 30 storing terminal fittings 21, a retainer 40 installed on the housing main body 30 by sliding from the side, and an outer housing 50 storing the housing main body 30 and provided with a movable lever 51.

The terminal fittings 21, shown as being slightly more enlarged than other parts shown in FIG. 4, are provided with barrel parts 21B at the back end of the square-pipe type contact part 21A, and the terminal part of an electric wire D is clamped on the barrel parts 21B together with a waterproof rubber stopper 22. Further, a metal lance 23 extends obliquely rearward from the upper wall of the contact part 21A, and a stabilizer 24 stands up at the side of the metal lance 23, as also shown in FIG. 12.

Figure 5:
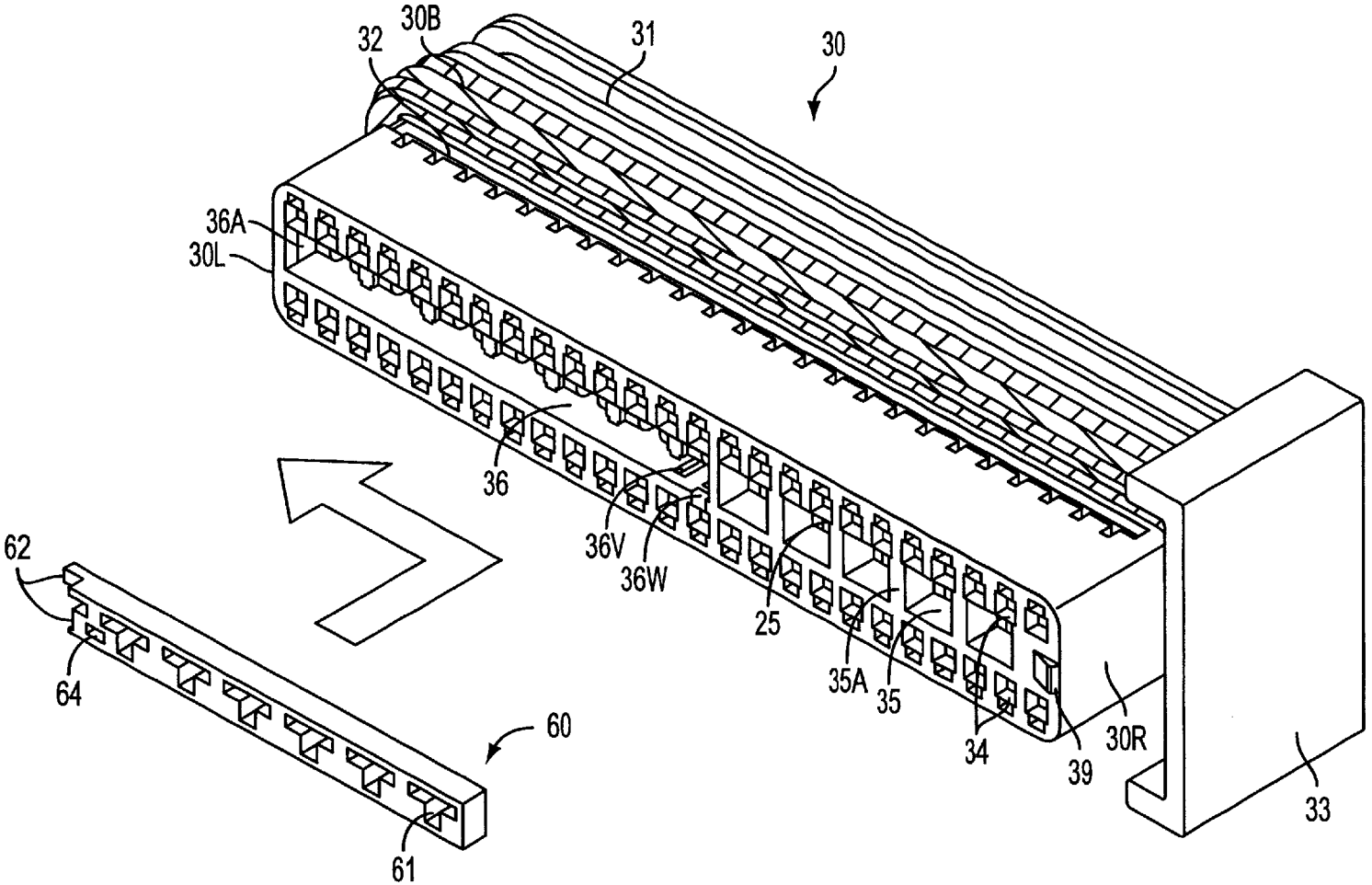
FIG. 5 is a perspective view of the housing main body and the slider.

As shown enlarged in FIG. 5, the housing main body 30 forms a long, generally rectangular parallelopiped shape, with a first rail groove 31 formed on the upper and lower walls and one side wall along the rim of the rear end, and an inwardly extending protrusion strip 52 formed in the outer housing 50 is hooked thereat. Further, a second rail groove 32 is formed at the middle position in the fore and aft direction along the upper and lower walls of the housing main body 30, in parallel with the first rail groove 31. The second rail groove 32 is opened to the left side face facing the housing main body 30 from the front, and the hooking protrusive strip 41 is installed in the retainer 40 and inserted from the open end by sliding.

Further, a waterproof ring 30B is fitted between both the rail grooves 31,32 among the housing main body 30. Additionally, a cover body 33 is unitarily molded on the side wall 30R of the right side face facing from the front among the housing main body 30. The cover body 33 is provided on the edge of a supporting pillar 33A (refer to FIG. 10) standing away from the rear end position of the side wall 30R. When the housing main body 30 is stored in the outer housing 50, the storing opening 50A (refer to FIG. 4) of the outer housing 50 is closed.

A plurality of cavities 34 are formed by penetrating the housing main body 30 in the fore and aft direction, and the terminal fittings 21 are stored in the interior of the cavities.

The plurality of cavities 34 are provided in the housing main body 30 in a condition in which they are transversely arranged in a pair of upper and lower rows, and a plurality of receiving part 35 are installed between the upper and lower rows of the cavities 34, in a condition in which they are transversely arranged in a single row. The respective receiving parts 35 are partitioned by section walls 35A so as to respective correspond with an adjacent pair among groups of the cavities 34 of the upper row, and open to the front of the housing main body 30. Further, as shown in FIG. 12, short circuit holes 35B which respectively communicate with a corresponding pair of the cavities 34 are formed by penetration.

A slider storing part 36 is formed in front of the housing main body 30 (FIG. 5). The slider storing part 36 is formed by removing the outer end parts of the section walls 35A partitioning the receiving parts 35 as it traverses a plurality of the receiving parts 35 at the left side in FIGS. 5 and 10 among groups of the receiving parts 35.

Figure 13A:
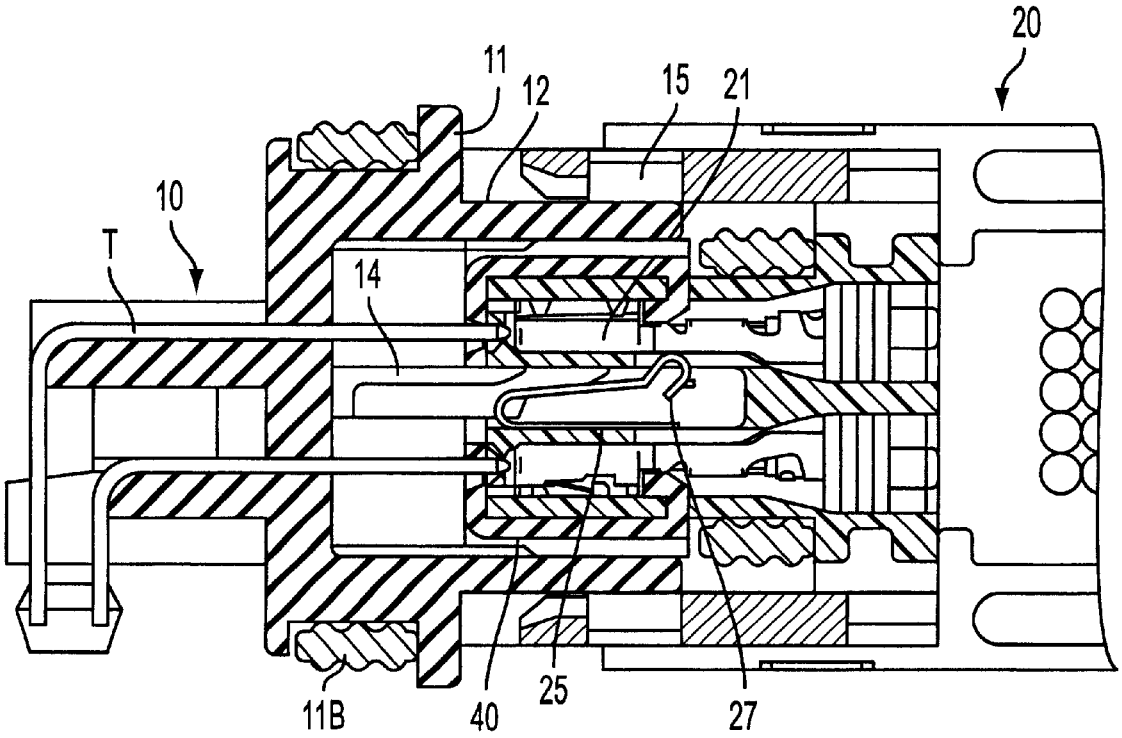
FIG. 13(A) is a cross-sectional side view of the initial fitting stage of both the connectors.
Figure 13B:
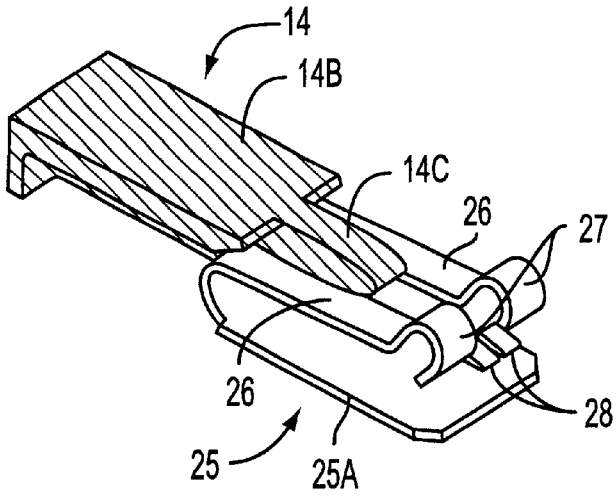
FIG. 13(B) is a perspective view showing the detection pins and the short circuit terminals at the initial stage.
Figure 14A:
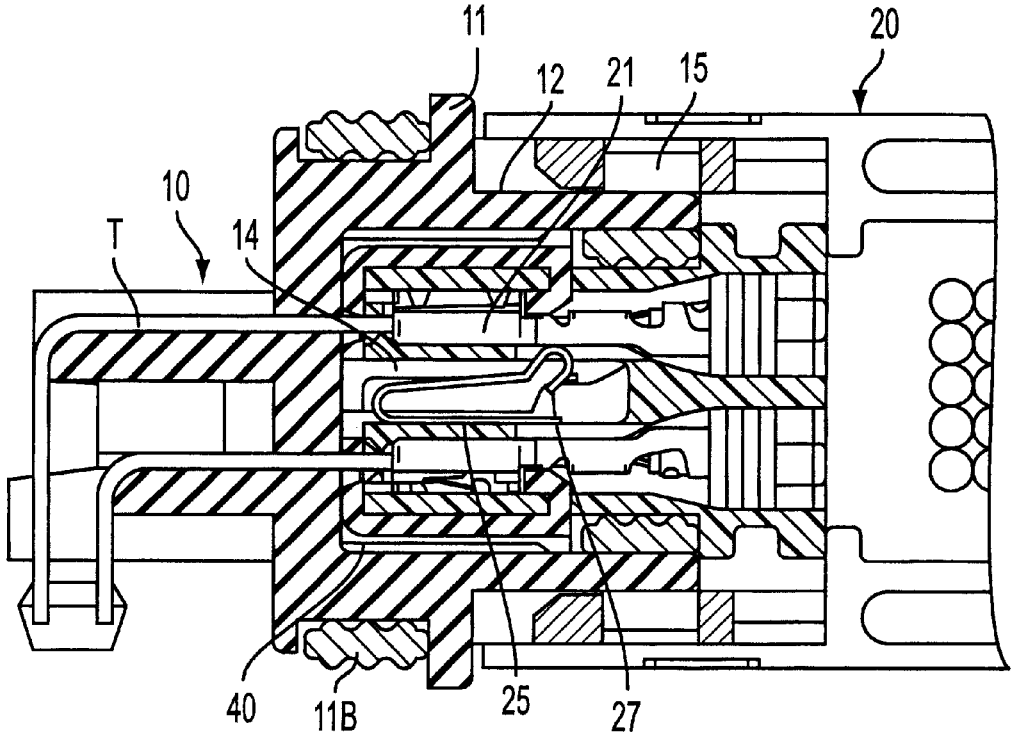
FIG. 14(A) is a cross-sectional side view of a condition in which both the connectors are completely fitted together.
Figure 14B:
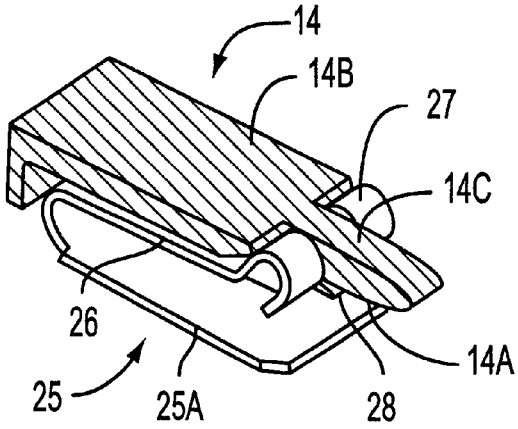
FIG. 14(B) is a perspective view showing the detection pins and the short circuit terminals when the connect are complete connected together.
Figure 15:
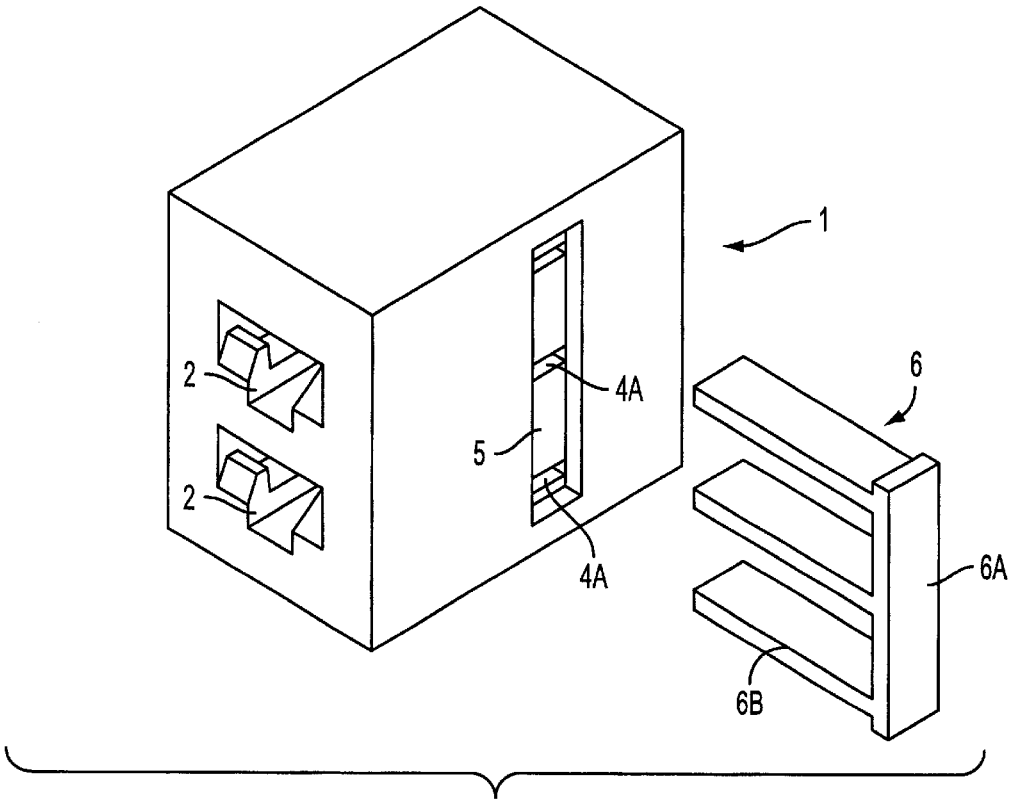
FIG. 15 (PRIOR ART)
FIG. 15 is a perspective view of a conventional connector.
Figure 16:
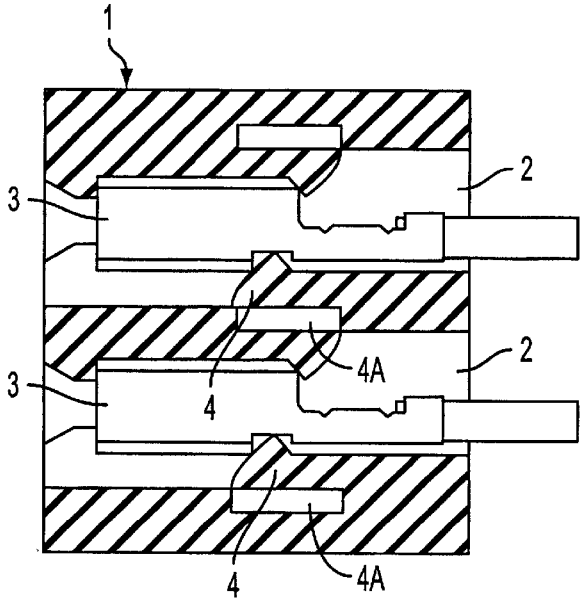
FIG. 16 (PRIOR ART)
FIG. 16 is a cross-sectional side view of the connector of FIG. 15.

Within the housing main body 30, short circuit terminals 25 are stored in the respective receiving parts 35 as shown in FIG. 12. As shown in FIG. 13(B), the short circuit terminal 25 includes a pair of bent short circuit pieces 26,26 which extend in parallel from one end of a metal plate 25A toward the upper side of the metal plate 25A, and the short circuit pieces are provided with bent protrusion parts 27 which are bent upwardly at an end part. Further, the inside parts of the edge sides of both the short circuit pieces 26 are provided with accepting parts 28 which project to the mutually approaching side and are bent upward at a lower position than the bent protrusion parts 27. The edge sides of the short circuit pieces 26,26 of short circuit terminals 25 are arranged at the inner side of the receiving parts 35, and are stored so that they do not protrude to the side of the slider storing part 36. And as shown in FIG. 12, the bent protrusion parts 27 of the short circuit terminals 25 are in contact with the terminal fittings 21 through the short circuit holes 35B. Thus, the terminal fittings 21,21 in one pair of the cavities 34,34 corresponding to the receiving parts 35 are mutually shorted thereby. Further, in the present mode of operation, the fitting-detection terminals related to the present invention are constituted by these terminal fittings 21,21 and the short circuit terminals 25.

The slider 60 shown in FIG. 5 is stored in the slider storing part 36 of the housing main body 30. The slider 60 extends in a horizontal direction, is pushed into the slider storing part 36 from an orthogonal direction against a longitudinal direction, and slides in a longitudinal direction inside of the slider storing part 36. Further, the hole 36A in the side wall 30L at left side (FIG. 10) of the housing main body 30 penetrates through to the slider storing part 36, and a pair of end part protrusion 62,62 are inserted in the hole 36A and protrude at the rear end at one end of the slider 60.

The slider 60 is provided with a plurality of pin permitting holes 61 along a longitudinal direction in correspondence with the respective receiving parts 35 which are positioned at the inner side of the slider storing part 36. The pin permitting holes 61 form a T-shape in cross-section. Further, on the slider 60, an end part hole 64 is formed at the end part on the side where the edge part protrusions 62 are installed.

Figure 6:
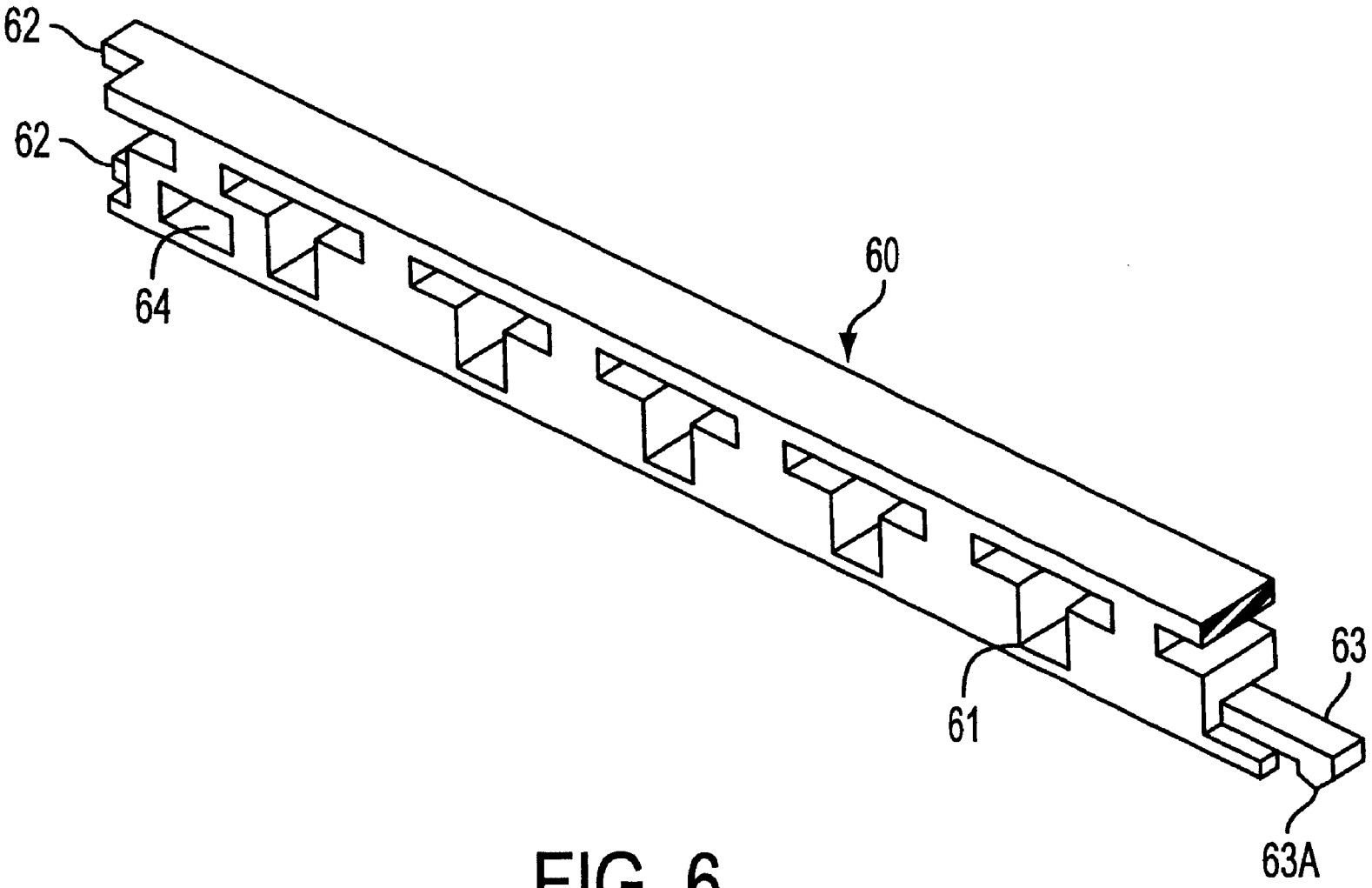
FIG. 6 is a partially cut-away perspective view of the slider.

Further, as shown in FIG. 6, a hooking piece 63 is provided at the lower face of the other end of the slider 60, and in correspondence with the hooking piece 63, a temporary hooking groove 36V and a final hooking groove 36W are arranged along the sliding direction at the end part of lower face of the slider storing part 36 (FIG. 5). Thus, when the slider 60 is positioned at the side of the side wall 30L within the slider storing part 36 (hereinafter, the position referred to as the "regulating position"), a protrusion part 63A which protrudes downwardly from the end of the hooking piece 63 is hooked with the temporary hooking groove 36V. Further, at this time, the edge part protrusions 62 which are provided at the other end of the slider 60 are inserted into the holes 36A, and the respective pin permitting holes 61 face the section walls 35A between the respective receiving parts 35 (FIG. 10(A)). On the other hand, when the slider 60 is positioned at the opposite side of the regulating position within the slider storing part 36 (hereinafter, the position referred to as the "permitting position"), the protrusion part 63A of the hooking piece 63 is hooked with the final hooking groove 36W. At this time, the pin permitting holes 61 are aligned with the respective receiving parts 35 (FIG. 10(B)).

Further, as both the temporary hooking groove 36V and the final hooking groove 36W are not opened to the front end face of the housing main body 30, the movement of the slider 60 toward the front of the slider storing part 36 is also regulated when the hooking piece 63 is hooked with the hooking grooves 36V, 36W.

As shown in FIG. 4, the retainer 40 is configured by connecting one end and one side rim of the upper and lower walls 40U and 40D which mutually extend in parallel along the upper and lower faces of the housing main body 30, with the end wall 40L and the frontal wall 40F, and openings are provided at the rear face and one side face thereof. At the opening rim of the rear face, a pair of hooking strips 41,41 protrude toward the mutually approaching side from the upper and lower walls 40U and 40D, and the edge parts of these hooking strips 41 take a shape overhanging toward the frontal side (FIG. 12). Further, a pair of ribs 47,47 extend in parallel in a front and rear direction on the outer faces of the upper and lower walls 40U and 40D, and these ribs 47,47 engage with the grooves 12A formed in the inner face of the hood part 12 of the male connector 10.

Figure 7:
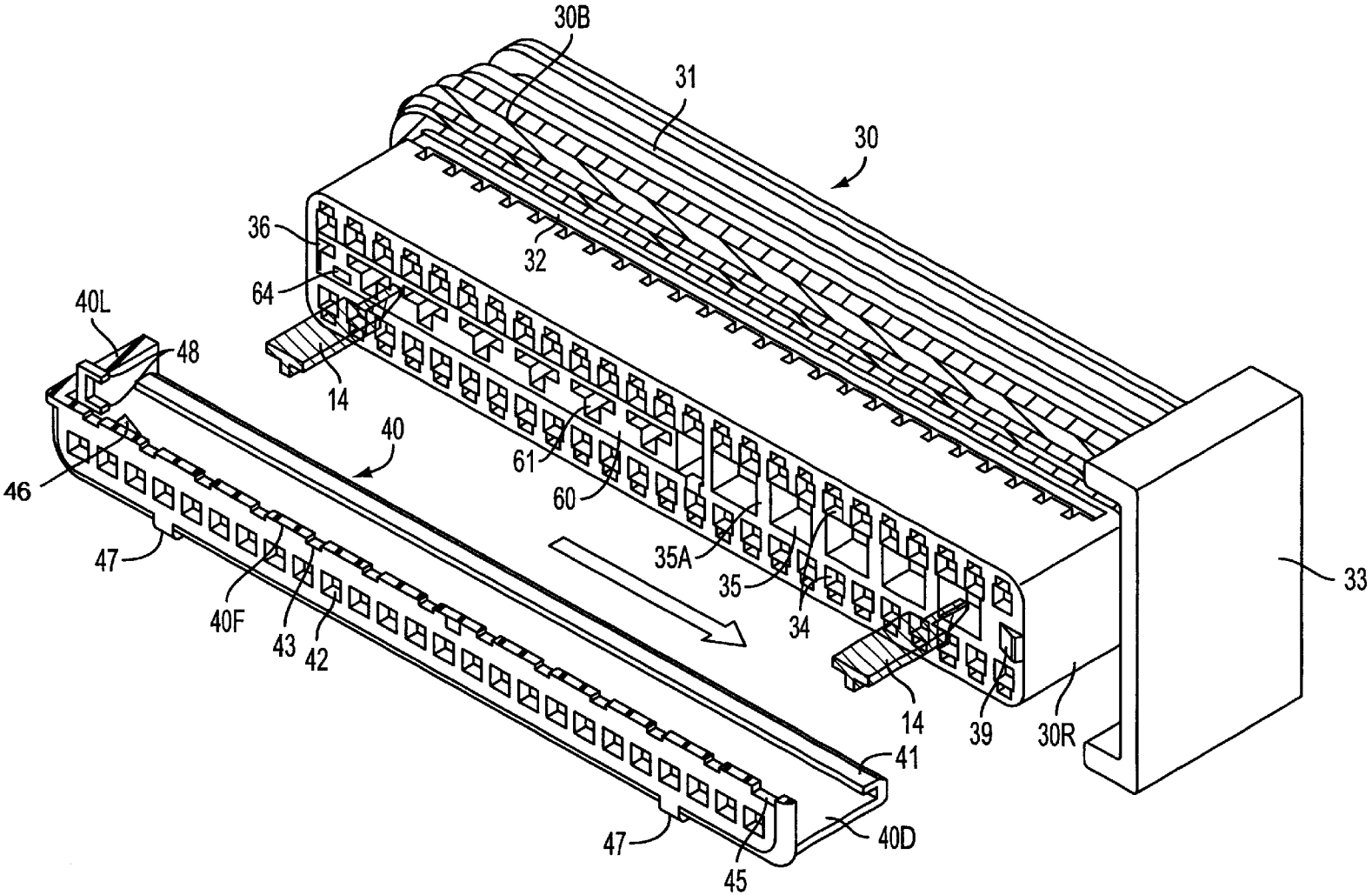
FIG. 7 is a perspective view of a condition in which the detection pins project toward the front of the housing main body.
Figure 8:
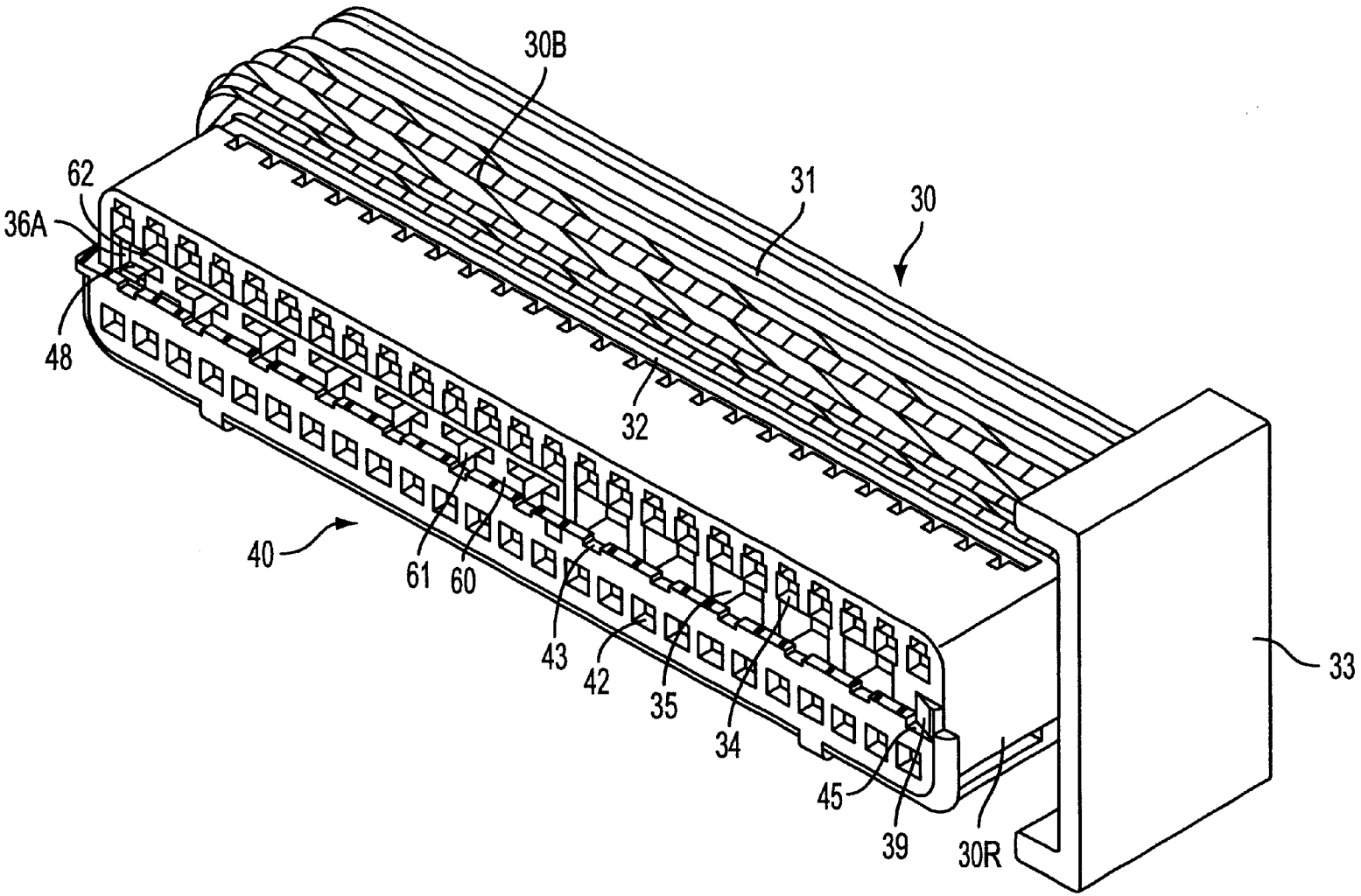
FIG. 8 is a perspective view of a condition in which the retainer is installed on the housing main body.

A plurality of tab insertion holes 42 corresponding to the respective cavities 34 are formed in two upper and lower rows on the front wall 40F of the retainer 40, and a plurality of pin insertion holes 43 corresponding to the respective receiving parts 35 are formed in a single row between the groups of two rows of the tab insertion holes 42. Further, a hooking hole 45 is formed at the side of the open side part 44S, and a frontal protrusion 39 which is formed on the front face of the housing main body 30 is hooked thereto. Additionally, as shown in FIG. 7, a rearward facing protrusion 46 is formed adjacent the end wall 40L on the inner face of the front wall 40F.

Further, a pair of slider contact protrusion parts 48,48 project from the inner face of the end wall 40L of the retainer 40. The pair of slider contact protrusion parts 48,48 fit into the side wall holes 36A formed on the side wall 30L of the housing main body 30 and are configured to abut against the edge part protrusions 62,62 of the slider 60.

As shown in FIG. 4, the outer housing 50 is configured by connecting the mutually facing upper and lower walls 50U and 50D with a back wall 50D and one side wall 50L, and the outer housing 50 is also provided with openings at the front and at one side face. Inwardly protruding strips 52 are provided on the inner faces of the upper and lower walls 50U and 50D of the outer housing 50. Additionally, end parts of a pair of leg pieces 54,54 provided on the lever 51 are connected, in a condition capable of rotation, on the outer faces of the upper and lower walls 50U and 50D.

Accordingly, the operation of the first mode of the present invention will now be described.

Figure 10A:
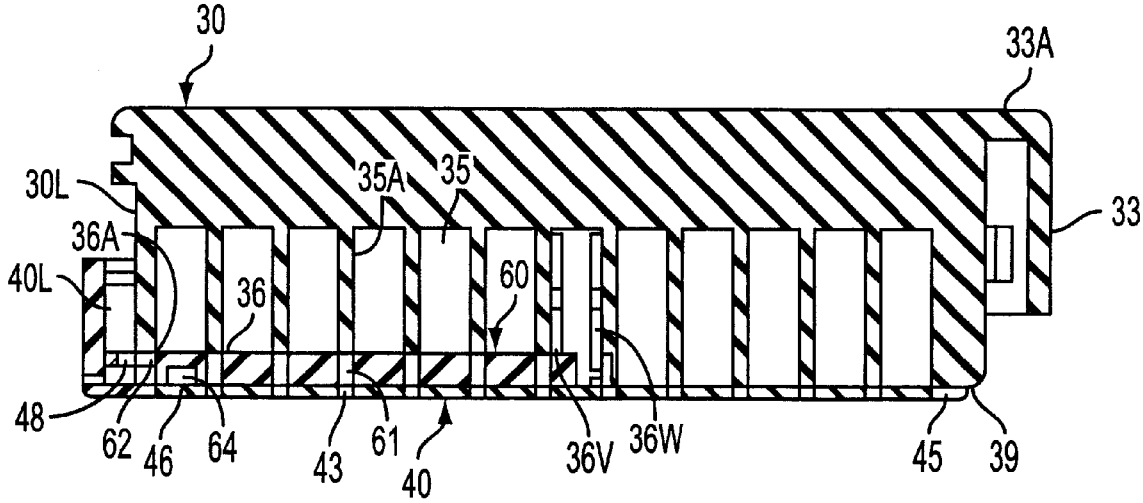
FIG. 10(A) is a cross-sectional plan view showing a condition in which the slider is positioned at the regulating position.
Figure 10B:
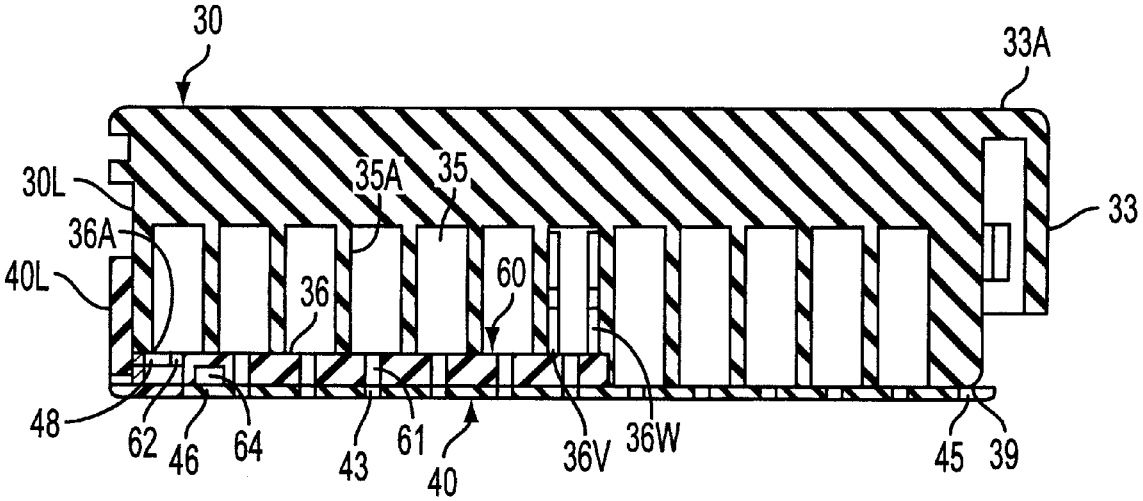
FIG. 10(B) is a cross-sectional plan view showing a condition in which the slider is positioned at the permitting position.

As shown in FIG. 4, the female connector 20 of the first mode of operation is provided to, for example, a harness plant in a condition in which the retainer 40 and the outer housing 50 are separately packed. The housing main body 30 is provided in a condition in which the short circuit terminals 25 are stored in the receiving parts 35 and the slider 60 is stored in the slider storing part 36. Further, the slider 60 is hooked in the regulation position of the housing main body 30 by hooking the hooking piece 63 (refer to FIG. 6) on the lower face of the slider, with the temporary hooking groove 36V provided on the lower face of the slider storing part 36. Thus, as shown in FIG. 10(A), a part of the groups of the receiving parts 35 installed in the housing main body 30 are placed in a condition in which they are blocked.

The terminal fittings 21 clamped on the terminal parts of electric wires D are pushed into the cavities 34 of the housing main body 30 in a harness plant (refer to STEP 1 of FIG. 4). Then, the metal lances 23 provided on the terminal fittings 21 are hooked with the inner walls of the cavities 34, and the terminal fittings 21 are locked in the cavities 34 (refer to FIG. 12). Further, at this stage, the adjacent pairs of the terminal fittings 21 stored in the upper row of the cavities 34 is respectively shorted by the short circuit terminals 25 in the receiving parts 35.

Next, the housing main body 30 is pushed into the open side part 44S of the retainer 40 (refer to STEP 2 of FIG. 4). At this time, the housing main body 30 is pushed into the retainer 40 while sliding the hooking protrusive strips 41 formed on the retainer 40 within the second rail groove 32 formed on the housing main body 30.

Figure 9A:
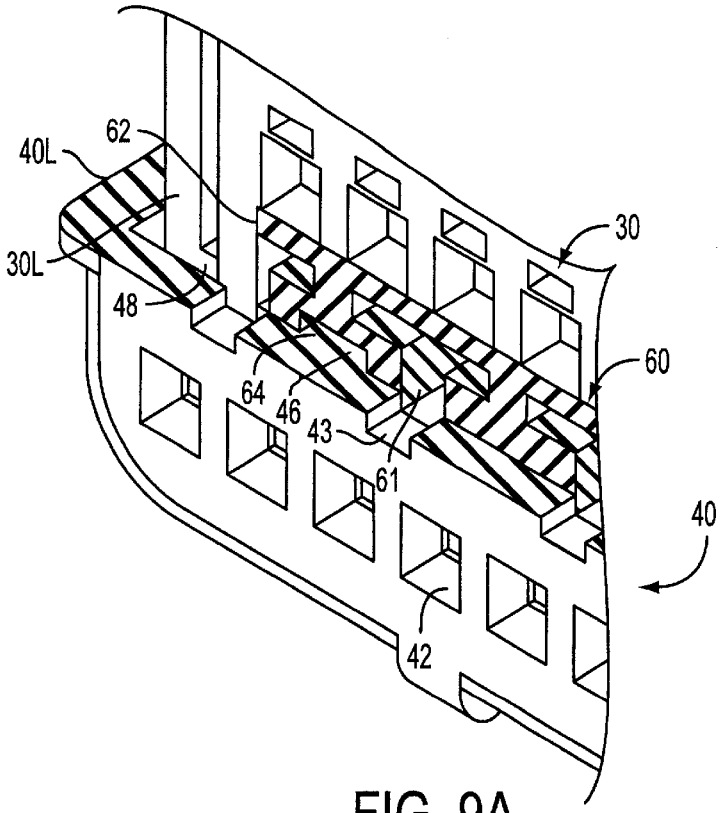
FIG. 9(A) is an enlarged partial perspective view showing a condition in which the slider is positioned at the regulating position.
Figure 9B:
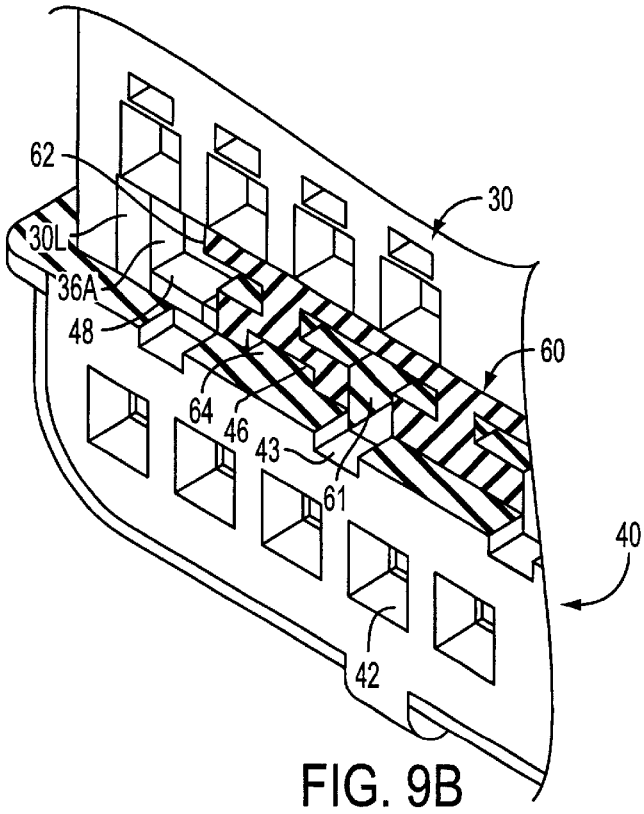
FIG. 9(B) is an enlarged partial perspective view showing a condition in which the slider is positioned at the permitting position.

Then, when the slider contact protrusion parts 48 installed on the end wall 40L of the retainer 40 approach the opening of the side wall holes 36A provided in the housing main body 30, the rearwardly facing protrusion 46 provided on the inner face of the retainer 40 passes over the side wall 30L of the housing main body 30 and is hooked with the end part hole 64 of the slider 60 as shown in FIG. 9(A), and the pin insertion holes 43 provided in the retainer 40 are aligned with the pin permitting holes 61 provided in the slider 60. And when the housing main body 30 is pushed further into the inner part of the retainer 40, the end part protrusions 62, arranged in the side walls holes 36A, on the slider 60 are pushed by the slider contact protrusion parts 48 of the retainer 40, and the slider 60 slides within the slider storing part 36 (refer to FIG. 9(B)).

When the retainer 40 is pushed into the final position of the housing main body 30, the slider 60 arrives at the permitting position, and the hooking hole 45 formed in the front wall 40F of the retainer 40 is hooked with the frontal protrusion 39 formed on the front face of the housing main body 30. The hooking piece 63 provided on the lower face of the slider 60 is hooked with the final hooking groove 36W provided on the lower face of the slider storing part 36. Then, the pin insertion holes 43 provided on the retainer 40 are aligned with the pin permitting holes 61 provided in the slider 60, and the tab insertion holes 42 provided in the retainer 40 are aligned with the cavities 34. Further, as shown in FIG. 12, the protruding hooking strips 41 provided on the retainer 40 face toward the rear end face of the connecting part 21A, and the terminal fittings 21 are double hooked within the cavities 34.

Finally, the housing main body 30 is inserted by sliding within the inner part of the outer housing 50 (refer to STEP 3 of FIG. 4), and thereby, the assembling of the female connector 20 is completed.

Figure 11A:
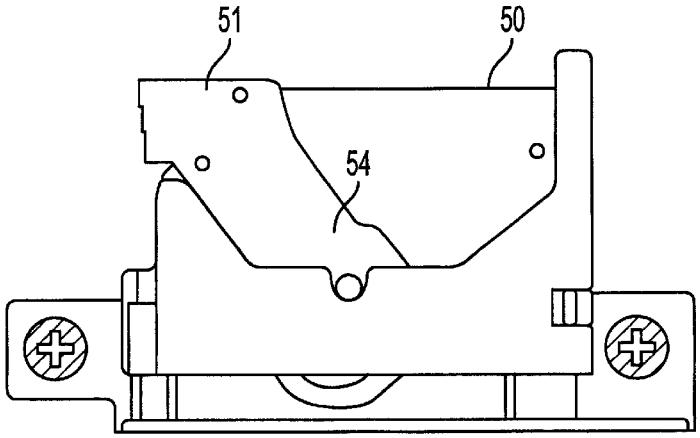
FIG. 11(A) is a side view showing a condition of the initial fitting of both the connectors.
Figure 11B:
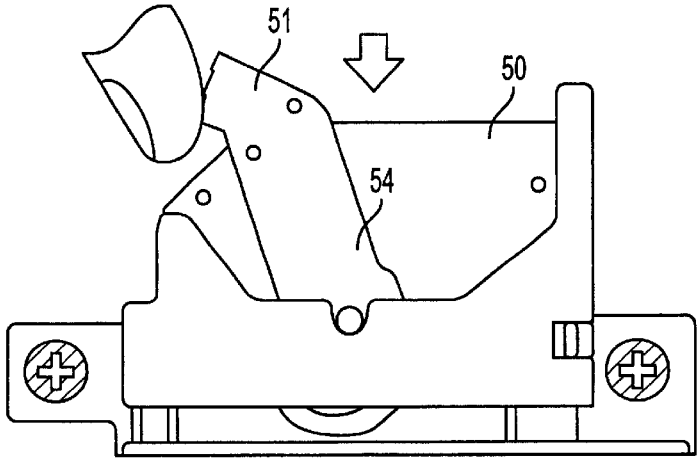
FIG. 11(B) is a side view showing a condition of the halfway fitting of both the connectors.
Figure 11C:
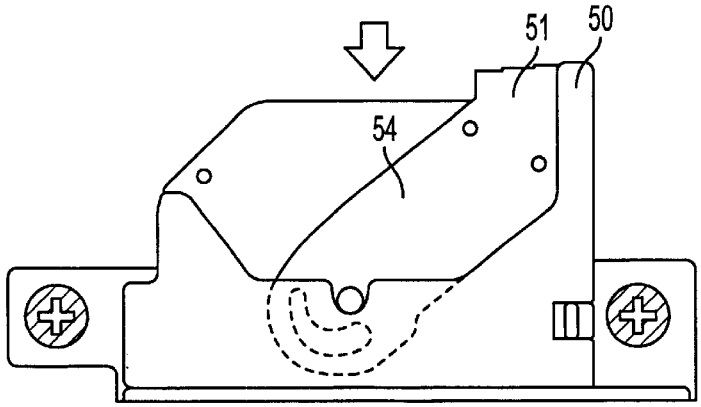
FIG. 11(C) is a side view showing a condition of the complete fitting of both the connectors.

The female connector 20 is provided, for example, in an assembling plant of electric instruments from a harness plant, along with the male connector 10. Then, the female connector 20 is combined with the male connector 10 of the opposite side. In order to do so, the cam pins 15 (refer to FIG. 1) provided on the male connector 10 are hooked with the cam grooves 51A (FIG. 4) of the lever 51 provided in the female connector 20, and the lever 51 is moved by rotation as shown in FIGS. 11(A) through 11(C). Then, both the connectors 10, 20 are drawn by the cam action, and the housing main body 30 of the female connector 20 is fitted within the hood part 12 of the male connector 10. Thereby, the tabs T that protrude within the interior of the hood part 12 penetrate the tab insertion holes 42 of the retainer 40, and project into the cavities 34 of the housing main body 30 at the inner part. Further, the detection pins 14 penetrate the pin insertion holes 43 of the retainer 40 and the pin permitting holes 61 of the slider 60, and project into the receiving parts 35 of the housing main body 30. Thereby, the respective tabs T are conducted to the terminal fittings 21 in the cavities 34 to be connected. On the other had, as shown in FIG. 13(A) through FIG. 14(A), the detection pins 14 rub the tapered faces 14A on the accepting parts 28 of the short circuit terminals 25 in the receiving part 35 and push down the short circuit pieces 26 of the short circuit terminals 25. Thus, the short circuit pieces 26 separate from the terminal fittings 21, and the adjacent pairs of terminal fittings 21,21 of the upper row become in a non-conductive condition respectively, therefore it can be detected that both the connectors 10,20 were properly fitted.

Furthermore, the present mode of operation, when the housing main body 30 is assembled with the outer housing 50 and then transferred to post processing in a condition in which the retainer 40 is inadvertently not installed, the following occurs. Namely, when the retainer 40 is not installed, the slider 60 is maintained hooked in the regulating position. Therefore one part of groups of the receiving parts 35 of the housing main body 30 are placed in the blocked condition by the slider 60. Thus, as shown in FIG. 7, when both the connectors 10, 20 are to be combined, the detection pins 14 are in contact with the slider 60 and insertion into the receiving parts 35 is regulated. Therefore, the combination of the connectors 10,20 becomes impossible.

Further, the retainer 40 may be removed from the housing main body 30, such as, for maintenance. In this case, the slider 60 returns to the regulating position together with the retainer 40 in the process of removing the retainer 40, due to the hooking of the rearward facing protrusion facing 46 of the retainer 40 with the end part hole 64 of the slider 60. Accordingly, when the female connector 20 is assembled again, the fitting of both connectors 10,20 also becomes impossible because of the interference of the detection pins 14 with the slider 60 as described above, even if the retainer 40 is inadvertently not installed.

Thus, according to the female connector 20 of the first embodiment, as the female connector 20 cannot be connected to the male connector 10 when the retainer 40 is inadvertently not installed, abnormality in the process of connection of the connectors 10, 20 can be caught, and a connector on which the retainer 40 is not installed can be prevented from being transferred to subsequent processes.

The present invention is no limited to the fore-mentioned embodiment and for example, the embodiments illustrated below is also included in the technical range of the present invention. Further, embodiments other than those described below can be carried out by various changes within the scope of the purpose of the present invention.

(1) The first embodiment provided a construction in which the detection pins 14 are installed on the male connector 10 and the detection pins 14 are in contact with the slider 60 at the regulating position. However, there may be, for example, a construction in which the tabs T installed on the male connector 10 are in contact with the slider 60 at the regulating position.

(2) The retainer 40 of the first embodiment was one which hooked on the rear end part of the terminal fittings 21. However, the present invention may be applied to, for example, a retainer having a construction in which the retainer advances into the bent cavity of the lance and regulates the deflection of the lance, in a manner similar to those illustrated in a conventional technology.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. HEI 11-122589, filed on Apr. 28, 1999, which is herein expressly incorporated by reference in its entirety.

What is claimed is:

1. A connector having a connector housing in which terminal fittings are housed, said connector comprising:

a retainer mountable on said connector housing by sliding to thereby allow the terminal fittings to be double hooked inside said connector housing;

an opposite connector provided with pins that protrude therefrom toward a fitting direction, said pins enter into a receiving part open in a front of said connector housing when said connector housing is fitted with said opposite connector;

said connector housing being provided with a slider that hooks at a regulating position regulating the entering of said pins into said receiving part, said slider being slidable from the regulating position in a direction traverse to said receiving part to a permissible position that permits the entering of said pins into said receiving part; and said retainer being provided with a slider contact part that contacts said slider during mounting on said connector housing and is configured to move the slider to said permissible position.

2. The connector according to claim 1, wherein an inside of said receiving part is provided with a pair of fitting-detection terminals in a contact condition, and said pins are formed by an insulation member and configured to fit between contact faces of both said fitting-detection terminals when said connector housing and said opposite connector engage in a normal fitting condition.

3. The connector according to claim 1, wherein a rear end wall which engages and moves away from a side wall of said connector housing is provided on the rear end of said retainer, in the sliding direction, and side wall holes communicating with a slider contact part are formed on the part facing said rear end wall among the side walls of said connector housing; and said slider contact part protrudes from said rear end wall and is configured to enter into said side wall holes.

4. The connector according to claim 2, wherein a rear end wall which engages and moves away from a side wall of said connector housing is provided on the rear end of said retainer, in the sliding direction, and side wall holes communicating with a slider contact part are formed on the part facing said rear end wall among the side walls of said connector housing; and said slider contact part protrudes from said rear end wall and is configured to enter into said side wall holes.

5. A connector assembly comprising:

a first connector connectable to a second connector;

said first connector including at least one outwardly protruding pin;

said second connector including a housing main body that houses at least one terminal fitting, a retainer slidably mountable on said housing main body to retain said at least one terminal fitting to a stored position, and a pin insertion prevention member that prevents insertion of said at least one protruding pin of said first connector in the event that said retainer is not mounted on said housing main body prior to connection of said first and second connectors;

said pin insertion prevention member comprising a slider slidably mounted in a recess in a front face of said housing main body;

said slider including at least one opening, and wherein in an insertion preventing position of said slider, said at least one opening is offset from an insertion path of said at least one pin, and in an insertion permitting position of said pin, said at least one opening is aligned with the insertion path of said at least one pin; and said retainer including a protrusion formed thereon, said protrusion being engageable with said slider upon mounting of said retainer on said housing main body, so that when said retainer is mounted on said housing main body to retain said at least one terminal fitting in the stored position, said protrusion engages and automatically shifts said slider from said insertion preventing position to said insertion permitting position.

6. The connector assembly according to claim 5, wherein said housing main body includes at least two adjacent cavities that receive a respective one of a pair of terminal fittings, and at least one receiving part positioned adjacent said at least two cavities;

a short circuit terminal insertable within said receiving part and connectable with said pair of terminal fittings; and wherein said pin of said first connector is receivable within said receiving part and engageable with said short circuit terminal to disconnect said short circuit terminal from said pair of terminal fittings.

7. The connector assembly according to claim 6, wherein said pair of terminal fittings are configured to provide a signal indicating an uninstalled condition of said retainer when said pair of terminals is contacted by said short circuit terminal, and to provide a signal indicating an installed condition of said pair of terminals when not contacted by said short circuit terminal.

8. The connector assembly according to claim 5, wherein said housing main body includes at least two adjacent cavities that receive a respective one of a pair of terminal fittings, and at least one receiving part positioned adjacent said at least two cavities;

a short circuit terminal insertable within said receiving part and connectable with said pair of terminal fittings; and wherein said pin of said first connector is receivable within said receiving part and engageable with said short circuit terminal to disconnect said short circuit terminal from said pair of terminal fittings.

9. The connector assembly according to claim 8, wherein said pair of terminal fittings are configured to provide a signal indicating an uninstalled condition of said retainer when said pair of terminals is contacted by said short circuit terminal, and to provide a signal indicating an installed condition of said pair of terminals when not contacted by said short circuit terminal.

10. The connector assembly according to claim 5, wherein said second connector further comprises an outer housing that slidably receives said housing main body and said retainer.

11. The connector assembly according to claim 10, wherein said outer housing is provided with a pivotable lever, said lever including at least one cam groove; and said first connector is provided with at least one cam pin receivable within said at least one cam groove, whereby rotation of said pivotable lever, when said cam pin is received within said cam groove, causes movement of said first connector toward engagement with said second connector.

12. The connector assembly according to claim 5, wherein said slider is provided with an elastically deflectable hooking piece, and said recess in said housing main body includes first and second hooking grooves; and wherein said hooking piece is engageable with said first hooking groove to temporarily retain said slider in said insertion preventing position, and said hooking piece is engageable with said second hooking groove to retain said slider in said insertion permitting position.

* * * * *